United States Patent [19]

Östbo

[11] 4,263,966

[45] Apr. 28, 1981

[54] HEAT-EXCHANGER

[76] Inventor: John D. B. Östbo, Byvägen 84-86, 151 52 Södertälje, Sweden

[21] Appl. No.: 61,462

[22] Filed: Jul. 27, 1979

[30] Foreign Application Priority Data

Aug. 3, 1978 [SE] Sweden ..... 7808367

[51] Int. Cl.[3] ..... F28F 19/00

[52] U.S. Cl. ..... 165/134 R; 165/166; 165/179; 165/180; 165/DIG. 8

[58] Field of Search ..... 165/179, 185, 180, DIG. 8, 165/133, 134, 165, 166

[56] References Cited

U.S. PATENT DOCUMENTS

| | | | |
|---|---|---|---|
| 1,682,404 | 8/1928 | Murray et al. | 165/185 |
| 1,759,582 | 5/1930 | Lonsdale | 165/179 |
| 1,881,610 | 10/1932 | Hyde | 165/179 |
| 2,017,676 | 10/1935 | Von Girsewald et al. | 165/DIG. 8 |
| 2,365,670 | 12/1944 | Wallace | 165/179 |
| 2,506,823 | 5/1950 | Wyant | 165/185 |
| 3,103,971 | 9/1963 | Freyholdt | 165/179 |
| 3,819,334 | 6/1974 | Yoshida et al. | 165/179 |
| 3,912,003 | 10/1975 | Schrade | 165/179 |
| 4,016,928 | 4/1977 | Bartels et al. | 165/179 |
| 4,089,324 | 5/1978 | Tjaden | 165/DIG. 8 |

FOREIGN PATENT DOCUMENTS

| | | | |
|---|---|---|---|
| 174928 | 11/1952 | Austria | 165/166 |
| 958140 | 1/1957 | Fed. Rep. of Germany | 165/185 |
| 1501454 | 10/1969 | Fed. Rep. of Germany | 165/170 |
| 2029781 | 12/1971 | Fed. Rep. of Germany | 165/DIG. 8 |
| 2095298 | 2/1972 | France | 165/166 |
| 558124 | of 1913 | United Kingdom | 165/134 |
| 635778 | 4/1950 | United Kingdom | 165/170 |
| 714369 | 8/1954 | United Kingdom | 165/179 |
| 1018843 | 2/1966 | United Kingdom | 165/179 |
| 1170636 | 11/1969 | United Kingdom | 165/170 |
| 1460032 | 12/1976 | United Kingdom | 165/DIG. 8 |
| 1468240 | 3/1977 | United Kingdom | 165/166 |
| 1469705 | 4/1977 | United Kingdom | 165/165 |

*Primary Examiner*—Sheldon J. Richter

*Attorney, Agent, or Firm*—Frishauf, Holtz, Goodman and Woodward

[57] ABSTRACT

The invention relates to heat-exchangers, especially of the type where the one medium is constituted by a gas or a vapor. It has a plurality of elongate elements which between themselves define the flow channels of the mediums. According to the invention, the elements comprise cores made of a material of high heat-conducting capacity. The cores are, at least partly, provided with a covering made of another material. The covering performs two functions; it keeps the cores fixed in their proper locations and they shield off the cores from direct contact with one of the two mediums. The covering may be metal or a synthetic resin.

6 Claims, 14 Drawing Figures

HEAT-EXCHANGER

BACKGROUND OF THE INVENTION

The present invention relates to heat-exchangers, especially of the type where the one medium is constituted by a gas or by a vapor, and which comprises a plurality of elongate elements defining between themselves flow channels for the two media of the apparatus.

The main object of the invention is to provide a heat-exchanger simultaneously satisfying the requirements for high efficiency and for usefulness also in such connections where either the one medium contains substances which may have a corroding or eroding effect on the surface-extending means of the heat-exchanger, or one medium must be protected from direct contact with those means.

Another object of the invention is to provide a heat-exchanger the heat-exchanging elements of which shall be designed so as to permit low-cost manufacture in a continuous process which may, by way of example, comprise extrusion or pressing steps.

SUMMARY OF THE INVENTION

A heat-exchanger according to the invention satisfies all of the above-mentioned requirements. In addition thereto, according to several embodiments of the invention, a further advantage is that the elements may very conveniently be cleaned thanks to their smooth and continuous surfaces. The main characteristic of the invention is that the elements comprise cores made of a material with high heat-conducting capacity, said cores being, at least partially, surrounded by a coating or covering of another material. The coating or covering fulfills a dual purpose. On the one hand, it shields off the cores from direct contact with the one medium, and, on the other, it serves to retain the cores fixed in their positions.

According to one preferred embodiment of the invention each core is constituted by an integral piece, suitably shaped as an elongate strip. It may consist of copper or of any other suitable material of high heat-conducting capacity, whereas the covering may consist of a synthetic resin material.

BRIEF DESCRIPTION OF THE DRAWINGS

Some embodiments of the invention will be described below, reference being made to the accompanying, diagrammatic drawing in which.

DETAILED DESCRIPTION

Figure 1:
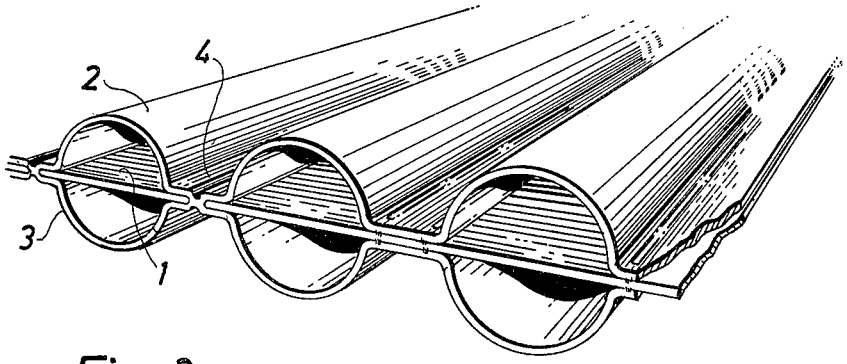
FIG. 1 is a perspective view showing a portion of a heat-exchanging element according to a first embodiment.

Turning now to FIG. 1, reference numeral 1 designates the core of the element there shown. It consists of a material of high heat-conducting capacity, preferably copper. It is shaped like an elongate plate or strip and at both sides is connected to a semi-circular sheet 2 and 3, respectively. As appears from the drawing, core 1 may either be individual to each pair of sheets 2 and 3 or common to two or more such pairs. Sheets 2 and 3 define passage channels for the one heat-exchanging medium. Each such channel is by core 1 divided into two parallel branches. The just-mentioned medium will accordingly flow in heat-exchanging contact with core 1. It will also be in contact with the inner walls of sheets 2 and 3. The other medium will only be in direct contact with sheets 2 and 3, to wit: with the outer walls thereof. The other medium will, however, be in indirect contact also with core 1, because the portions of sheets 2 and 3 located between each circular passage for the first-mentioned medium may be looked upon as a covering for the flange-like portions of core 1 protruding outside the circumference of the flow channels of the first-mentioned medium. Numeral 4 designates such a portion of the element. Cores 1 may be secured to sheets 2 and 3 in any appropriate way, such as by welding, brazing, or clamping.

A number of elements, such as illustrated in FIG. 1, may be placed on top of each other forming a stack. It should also be noted that the profile of cores 1 does not need to be plane. By way of example, the profile may be curved, the radius of curvature being considerably greater than the radius of the circular flow channels. In such an element the individual channels will be disposed along a circular or helical line in the circumferential direction of the heat-exchanger.

Sheets 2 and 3 are generally made of a material which does not chemically or physically interact with the medium flowing in contact with their outer walls. As mentioned above, this means that either that medium or the cores 1, or both, are protected. A protection of the medium from direct contact with the copper cores 1 is of importance, e.g. in heat-exchangers used in food stuff or pharmaceutical industries. Conversely, a protection of the cores 1 is desired when the outer medium contains aggressive substances, e.g. is constituted by a gas or a vapor having a corroding or eroding influence on copper. Sheets 2 and 3 may consist of a metallic material or of a synthetic resin.

It should be noted that the portions of sheets 2 and 3 serving as a covering for the protruding parts of cores 1 simultaneously perform a second function, they retain cores 1 in their positions.

Figure 2:
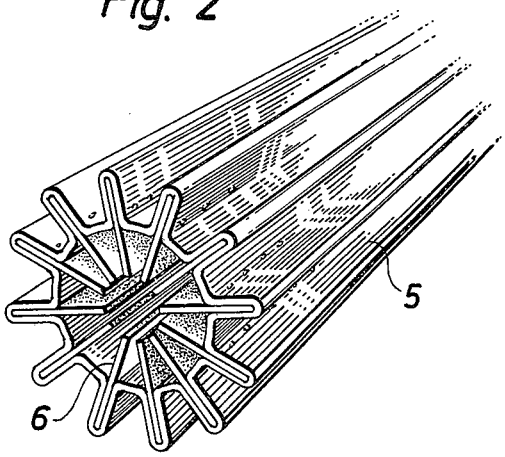
FIG. 2 is a perspective view showing a portion of an element according to a second embodiment.

The profile of the element shown in FIG. 2 is that of a multi-pointed star. Its contour is defined by an outer sheet 5 having a plurality of folds each carrying a radially inwardly directed core 6 in the form of an elongate rectangular strip. The outer portion—according to the illustrated embodiment approximately half of the width—is accordingly at both sides covered by sheet 5, whereas the inner portions of the strips 6 project freely into the circular flow passage for the one medium. As should be understood, the folds of sheet 5 again perform a dual function, they retain strips 6 and they may serve as protection.

Figure 3A:
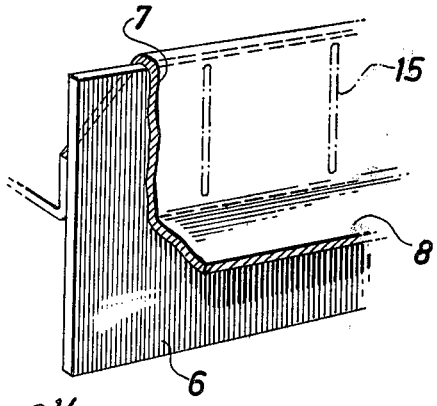
FIG. 3*a* shows on a larger scale a detail of the arrangement in FIG. 3.
Figure 3:
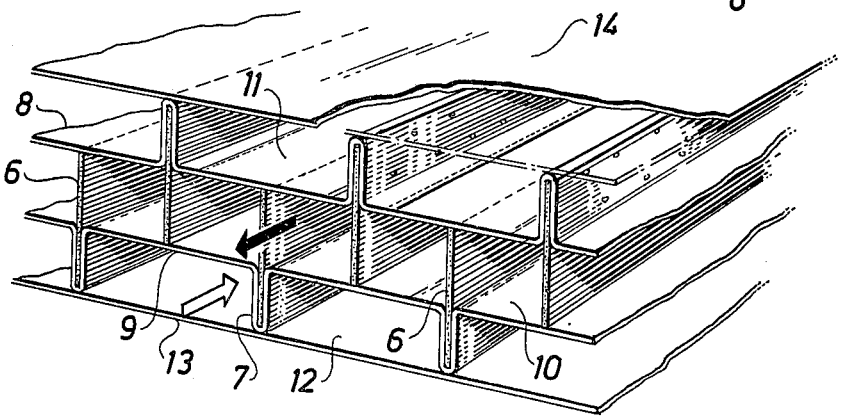
FIG. 3 is a partly sectional perspective view showing an element according to a third embodiment.

Also in the embodiment illustrated in FIG. 3 cores 6 consist of a plurality of elongate, rectangular metal strips. In this case, they are, however, arranged in parallel planes—rather than in the same plane as in FIG. 1 or in different planes as in FIG. 2. Sheets 8 and 9 have folds 7 surrounding the one edge portion of each strip 6 so as to serve as a covering and as a retaining means. Sheets 8 and 9 are stacked on top of each other, so that two different types of flow channels are formed. In the intermediate level there are formed channels 10, partly defined by the uncovered portions of strips 6. Below and above that level there are formed channels 11 and 12, respectively, each of which is omnilaterally defined by sheets 8 or 9, i.e. the medium flowing through these channels will only be in indirect contact with core strips 6.

The larger scale illustration in FIG. 3*a* shows one fold 7 surrounding a core strip 6. Numeral 15 designates embossments or depressed zones generated upon the fixation of the strip in the fold, e.g. by a roll-pressing operation. As should be understood, the corresponding possibility to manufacture the elements permits use of a process yielding a continuous coated or covered strip which is then divided into shorter pieces. In this connection it should be mentioned that the extent to which each strip 6 is coated or covered must be determined in each case with consideration being paid to the actual parameters, especially the relative thickness of the strips and the heat content of the heat-delivering medium.

Figure 4:
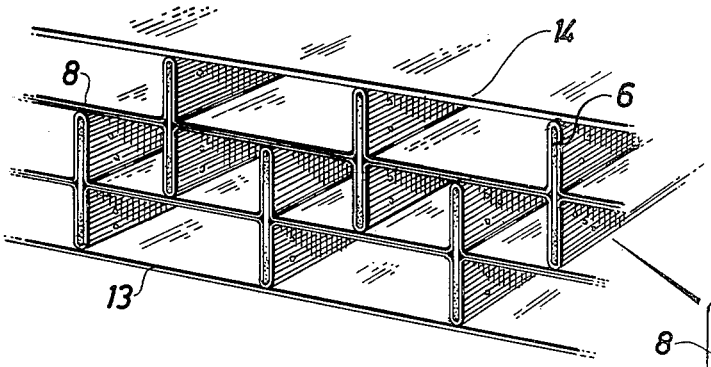
FIG. 4 corresponds to FIG. 3 but discloses a fourth embodiment.
Figure 4A:
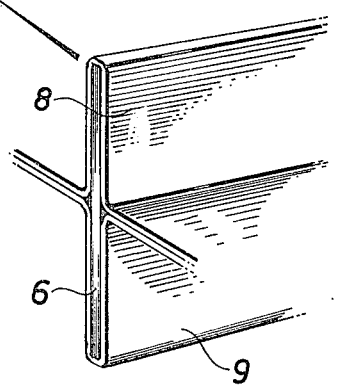
FIG. 4*a* corresponds to FIG. 3*a* but relates to FIG. 4.

FIG. 4 differs from FIG. 3 only in the way that strips 6 are completely coated or covered which is more clearly apparent from FIG. 4*a*.

Figure 5:
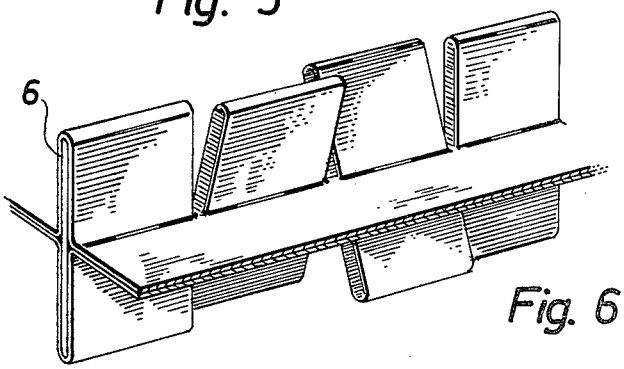
FIG. 5 is a perspective view showing a portion of an element according to a fifth embodiment.

FIG. 5 illustrates a modification of the embodiment shown in FIG. 4, the difference being that the strip has by cross-wise cuts been subdivided into a plurality of successive portions assuming mutually different angular positions. Also the end surfaces of these flap-like strip portions may be provided with a covering material so that the strip becomes omnilaterally coated or covering. The main advantage of this embodiment is that the relative displacement of the strip flaps generates turbulence, thereby improving the heat transfer.

Figure 6:
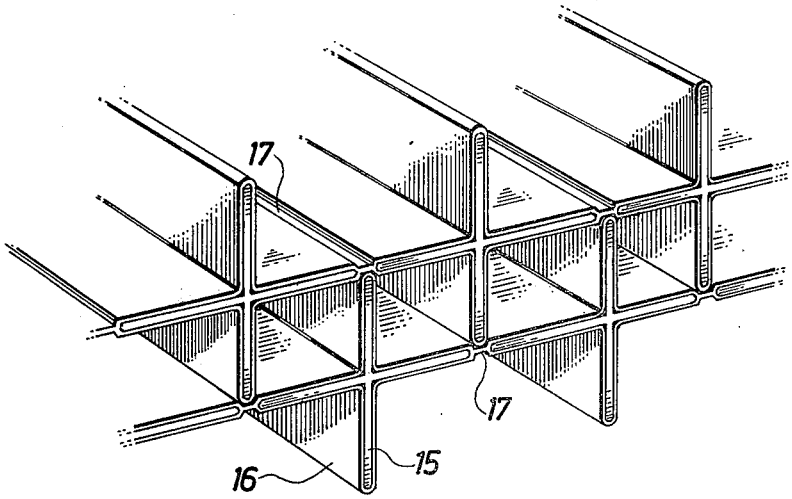
FIGS. 6–12 each show a further embodiment of the invention.

In the embodiment shown in FIG. 6 strips 15 are of cruciform profile and omnilaterally surrounded by a covering material 16. Adjacent strips are interconnected via thin bridges 17 consisting of the covering material. At both sides of these bridges there is accordingly formed a groove which, as shown on the drawing, receives one end of a strip in an adjacent layer the strips of which are staggered in relation to the layer first referred to.

Figure 7:
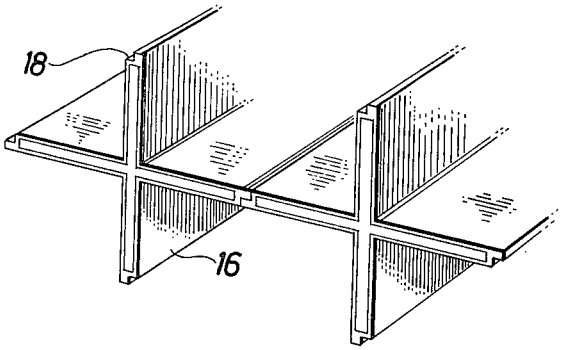

The sole difference between FIG. 7 and FIG. 6 is that at each of the four free ends of the cruciform strip covering material 16 has been given an L-shaped profile, so that there are formed grooves 18 for the interconnection of the strips.

Figure 8:
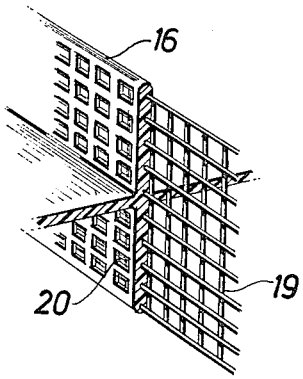

According to FIG. 8, covering material 16 surrounds an elongate body 19 consisting of a metal wire grid. The covering material here consists of a synthetic resin and the covering, at each grid frame, has a depression 20 which may alternatively be a through aperture.

Figure 9:
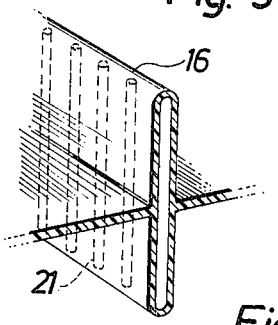

Also in FIG. 9 covering 16 consists of a resin material omnilaterally surrounding the core. However, in this case the core is discontinuous in the longitudinal direction of the core in that it consists of a number of embedded metal rods 21.

Figure 10:
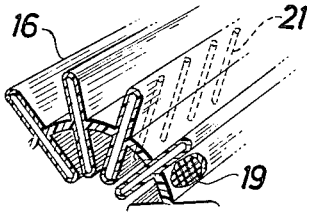

In FIG. 10 the principles of design illustrated in FIGS. 8 and 9 have been combined in the way that the fold-like portions of covering material 16 surround metal rods 21, whereas the arcuate portions surround a wire grid 19.

Figure 11:
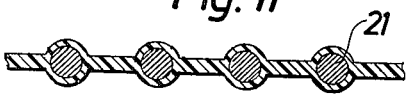

FIG. 11 shows a cross-section through a portion of an element having embedded metal rods 21. In this case the outer walls of the covering material follow the curvature of the rods.

Figure 12:
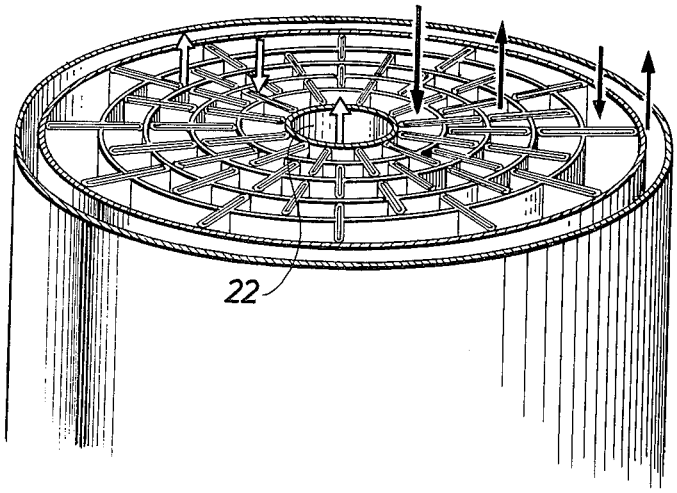

Finally, FIG. 12 diagrammatically shows a portion of a complete heat-exchanger. The flow direction of the one medium has been marked with white arrows and that of the other medium with black arrows. The first-mentioned medium enters through a central tube 22 and the return flow, as seen in the radial direction, occurs through every second of the circular element layers. The other medium accordingly flows through the intermediate layers.

Finally, it should be noted that the term "heat-exchanger" as used here should be interpreted in a functional rather than a literal sense. It is intended to cover also such types of apparatus where the heat-exchanging function may not be the primary one. It should also be apparent from the description above that the invention is not limited to any special method as far as the application of the coating or covering material is concerned. In addition to extrusion and clamping processes, molding, milling and pressing, including powder-pressing, may be used. It is also possible to apply e.g. tin or a thermosetting cement on the interface between the cores and the coating or covering, melting of the tin layer or curing of the cement, respectively, being accomplished by external heat-supply, e.g. by means of heated rollers used in a pressing operation.

What I claim is:

1. A heat-exchanger for heat exchange between two mediums, comprising a plurality of longitudinal elements defining between themselves flow passages of the heat-exchanger, the elements each comprising cores made of a material having high heat-conducting capacity, said cores being at least partially surrounded by a covering of another material, and said cores comprising a plurality of elongated strips made of said material having high heat-conducting capacity, said elongated strips being arranged in substantially parallel planes and being spaced from each other, said elongated strips being partially covered on both sides thereof by said another material so as to provide alternate flow passages for said two mediums, one flow passage being in direct communication with the uncovered portions of said elongated strips and the other alternate flow passages being in direct contact with said another material and being out of direct contact with said uncovered portions of said elongated strips, said covering serving the dual purpose of preventing direct contact between the cores and said one medium and retaining the cores fixed in their positions.

2. A heat-exchanger as claimed in claim 1, wherein each core consists of an integral part.

3. A heat-exchanger as claimed in claim 1, wherein said cores have a plurality of projections extending therefrom, each projection comprising a projecting member made of said material having high heat-conducting capacity, and said projections, at least over their projecting portions, each being covered on both surfaces by said another material.

4. A heat-exchanger as claimed in claim 1 or 3 wherein said elongated strips are generally rectangular and said flow passages are generally rectangular.

5. A heat-exchanger as claimed in claim 4 wherein said elongated strips are arranged such that adjacent strips are longitudinally offset with respect to each other so as to provide three levels of flow passages for said mediums, said medium which flows through the flow path out of direct contact with said strips flowing through the outer levels, and said medium which is in direct contact with said strips flowing through the passages which are on a level which is interposed between said outer levels.

6. A heat-exchanger as claimed in claim 1 or 3 wherein said material having high heat-conducting capacity is metal.

* * * * *